US010743401B2

(12) United States Patent
Abs et al.

(10) Patent No.: US 10,743,401 B2
(45) Date of Patent: Aug. 11, 2020

(54) VARIO-ENERGY ELECTRON ACCELERATOR

(71) Applicant: Ion Beam Applications S.A., Louvain-la-Neuve (BE)

(72) Inventors: Michel Abs, Louvain-la-Neuve (BE); Jeremy Brison, Louvain-la-Neuve (BE); Willem Kleeven, Louvain-la-Neuve (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 0 days.

(21) Appl. No.: 16/698,149

(22) Filed: Nov. 27, 2019

(65) Prior Publication Data

US 2020/0170099 A1 May 28, 2020

(30) Foreign Application Priority Data

Nov. 28, 2018 (EP) ..... 18208924

(51) Int. Cl.
*H05H 13/10* (2006.01)
*G21K 1/093* (2006.01)
(Continued)

(52) U.S. Cl.
CPC ..... *H05H 13/10* (2013.01); *G21K 1/093* (2013.01); *G21K 5/04* (2013.01); *H05H 7/02* (2013.01);
(Continued)

(58) Field of Classification Search
None
See application file for complete search history.

(56) References Cited

U.S. PATENT DOCUMENTS

2016/0113104 A1* 4/2016 Abs ..... H05H 7/04 315/501

FOREIGN PATENT DOCUMENTS

CA 2832816 5/2015
CN 105578703 A * 5/2016 ..... H05H 13/10
(Continued)

OTHER PUBLICATIONS

European Search Report issued by the European Patent Office in the counterpart European Patent Application No. EP 18 20 8924 dated May 21, 2019; 8 pages.

*Primary Examiner* — Dedei K Hammond
(74) *Attorney, Agent, or Firm* — Finnegan, Henderson, Farabow, Garrett & Dunner LLP

(57) ABSTRACT

A vario-energy electron accelerator includes a resonant cavity consisting of a closed conductor, an electron source injecting a beam of electrons into the resonant cavity, an RF system coupled to the resonant cavity and generating an electric field in the resonant cavity, magnet units centred on a mid-plane and generating a field in a deflecting chamber in fluid communication with the resonant cavity, the magnetic field deflecting along a first deflecting trajectory of adding length an electron beam exiting the resonant cavity along a first radial trajectory to reintroduce it into the resonant cavity along a second radial trajectory, an outlet for extracting along an extraction path an accelerated electron beam from the resonant cavity towards a target, wherein at least one of the magnet units is adapted for modifying the first deflecting trajectory to a second deflecting trajectory, allowing a variation of the energy of the electron beam.

13 Claims, 6 Drawing Sheets

(51) Int. Cl.

| | |
|---|---|
| ***G21K 5/04*** | (2006.01) |
| ***H05H 7/02*** | (2006.01) |
| ***H05H 7/18*** | (2006.01) |
| ***H05H 7/08*** | (2006.01) |
| ***H05H 7/04*** | (2006.01) |

(52) U.S. Cl.

CPC ..... *H05H 7/04* (2013.01); *H05H 7/08* (2013.01); *H05H 7/18* (2013.01); *H05H 2007/025* (2013.01); *H05H 2007/046* (2013.01); *H05H 2007/084* (2013.01)

(56) References Cited

FOREIGN PATENT DOCUMENTS

| | | | |
|---|---|---|---|
| CN | 105578703 | B | 6/2018 |
| CN | 207638964 | U | 7/2018 |
| EP | 0359774 | | 4/1993 |
| EP | 3319402 | | 5/2018 |
| EP | 3319403 | | 5/2018 |
| WO | WO-2016/193294 | | 12/2016 |

* cited by examiner

FIG.1A: 7 MeV (Prior Art)
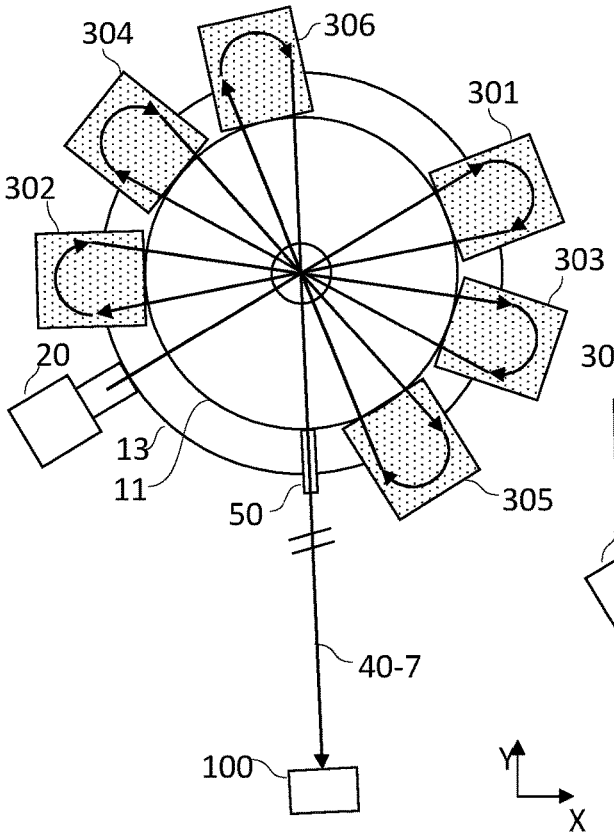
FIG.1B: 5MeV (Prior Art)
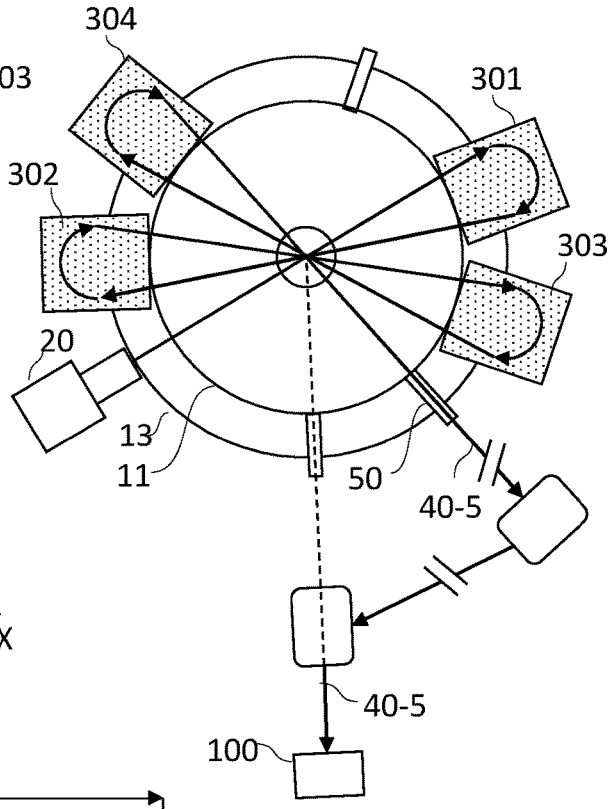
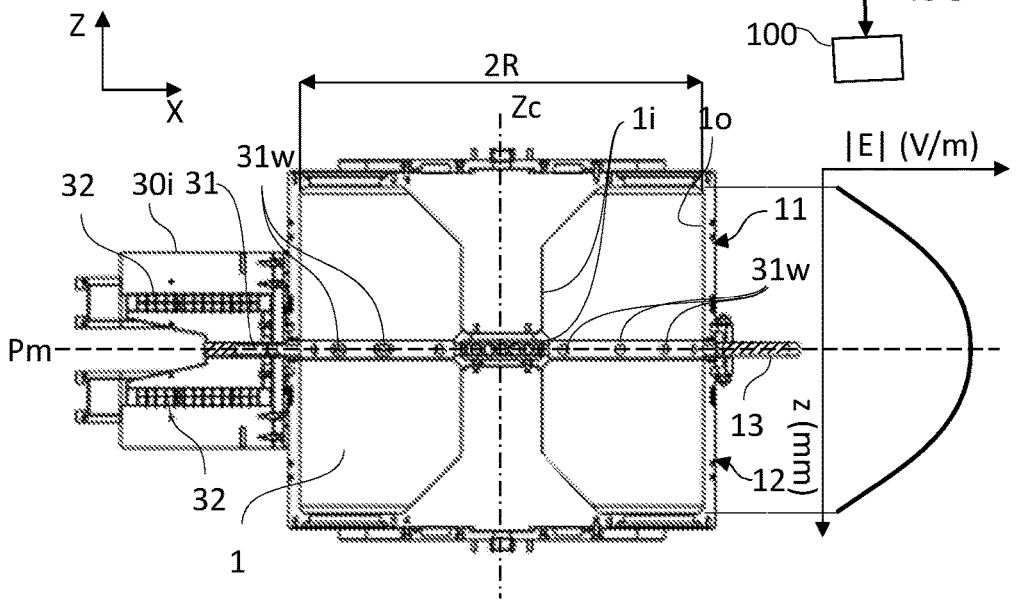
FIG.4

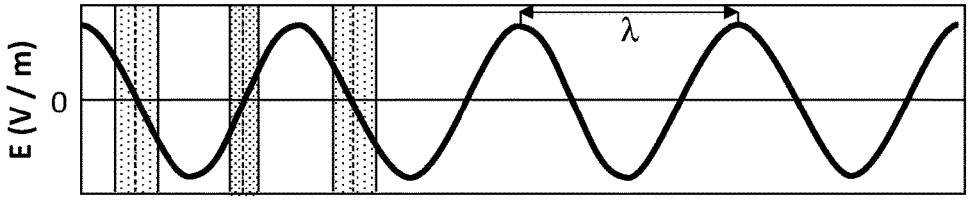
FIG.2A
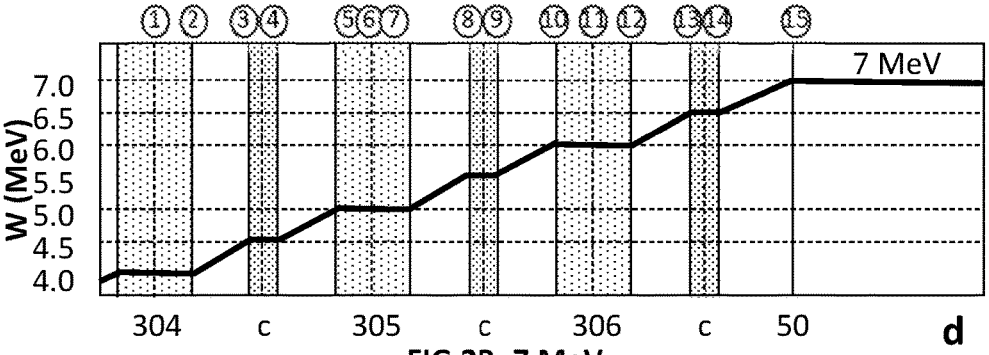
FIG.2B: 7 MeV
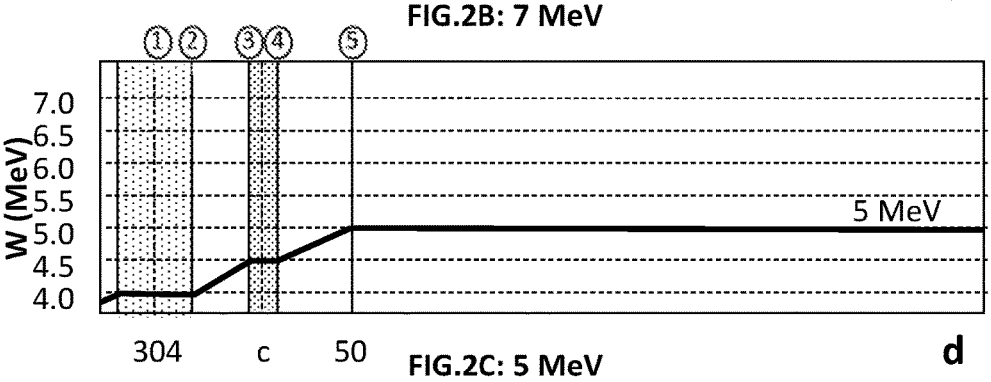
FIG.2C: 5 MeV
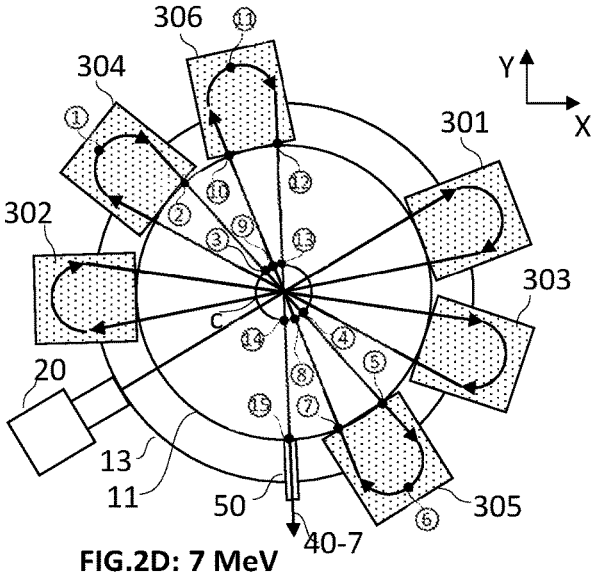
FIG.2D: 7 MeV
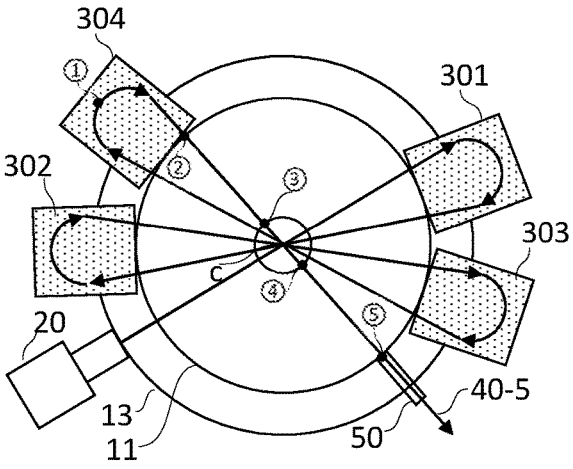
FIG.2E: 5 MeV
(Prior Art)

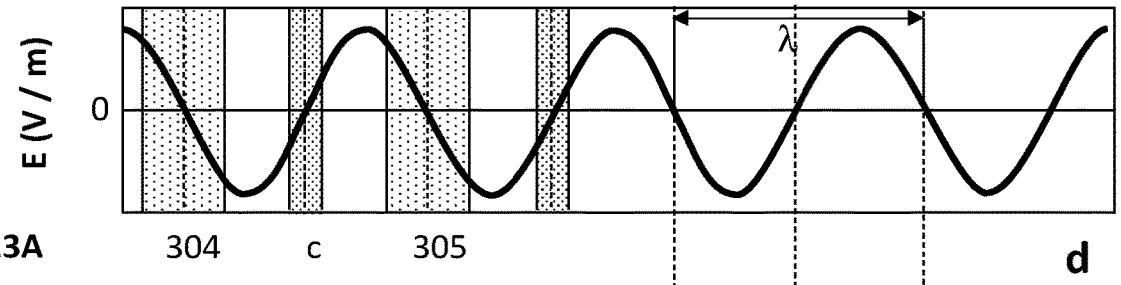
FIG.3A
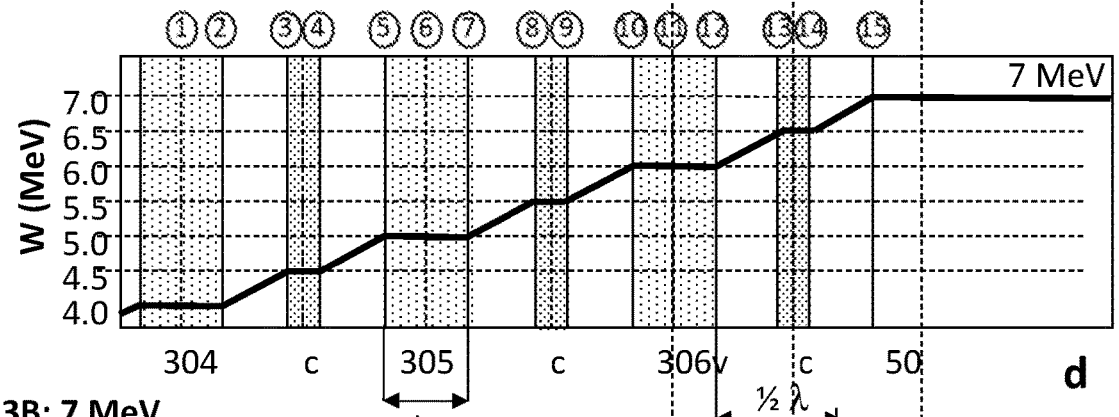
FIG.3B: 7 MeV
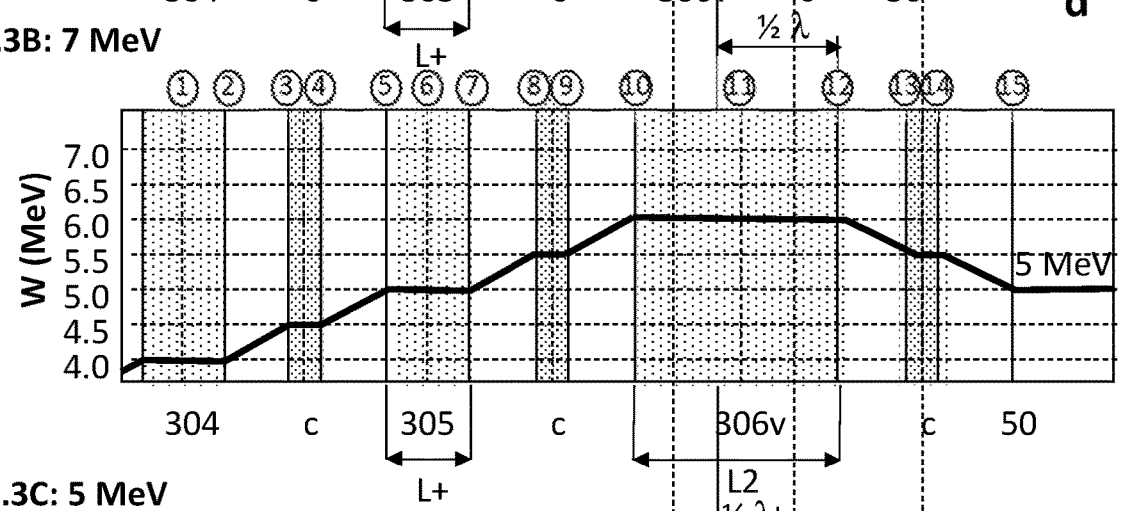
FIG.3C: 5 MeV
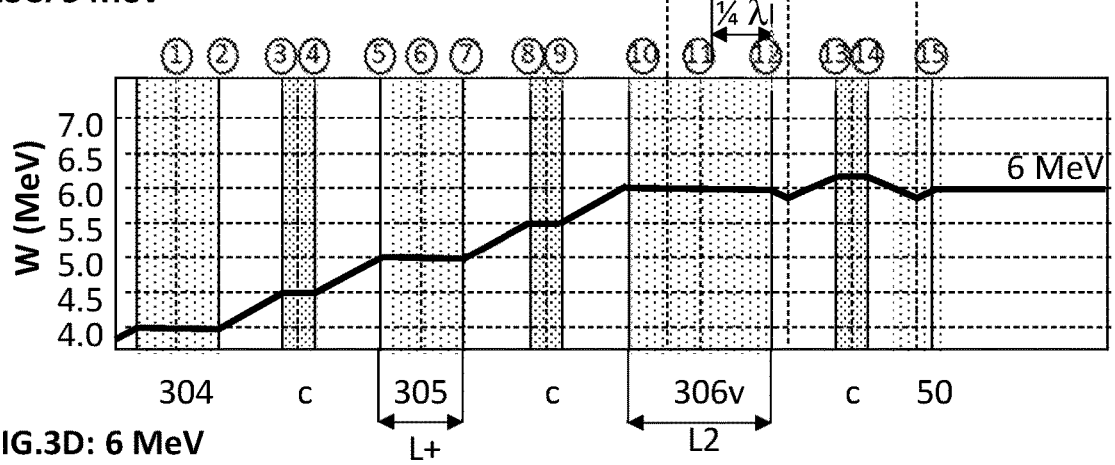
FIG.3D: 6 MeV

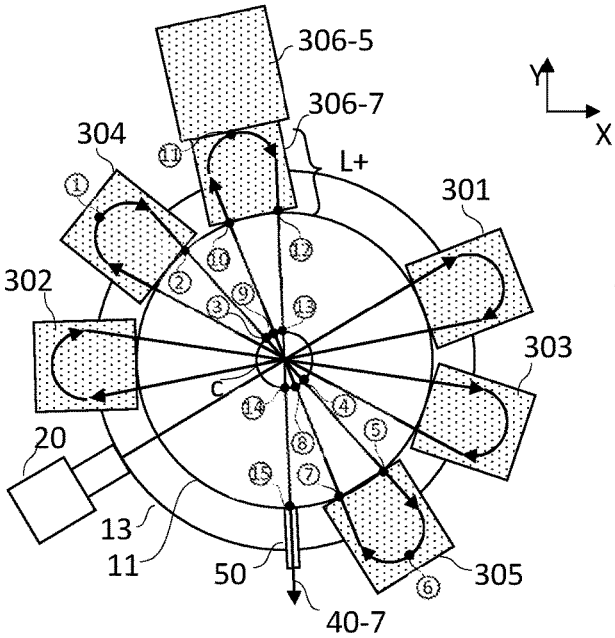
FIG.3E: 7 MeV
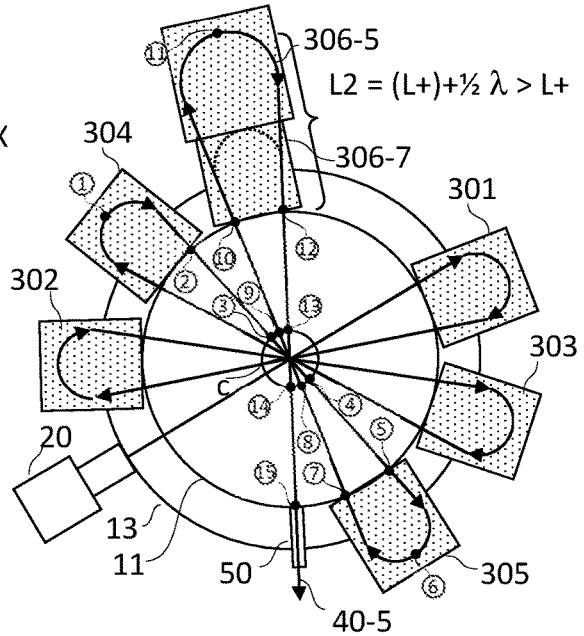
FIG.3F: 5 MeV
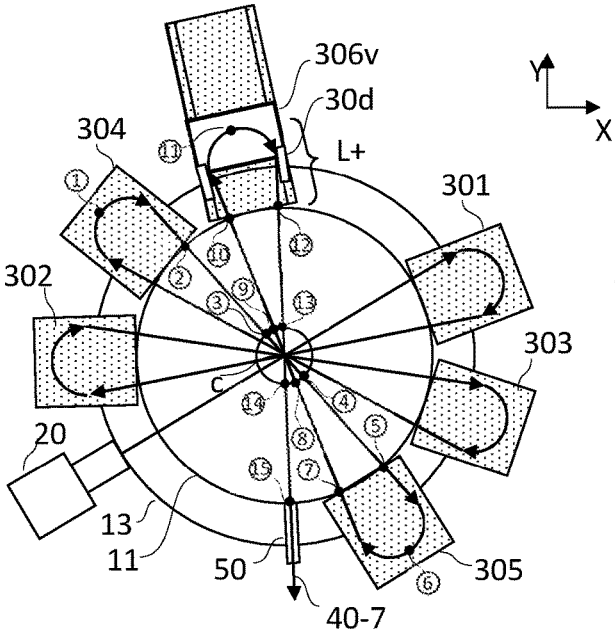
FIG.3G: 7 MeV
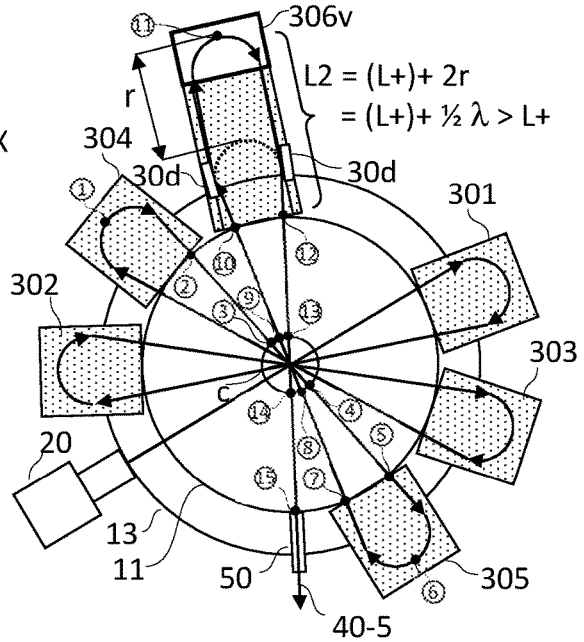
FIG.3H: 5 MeV

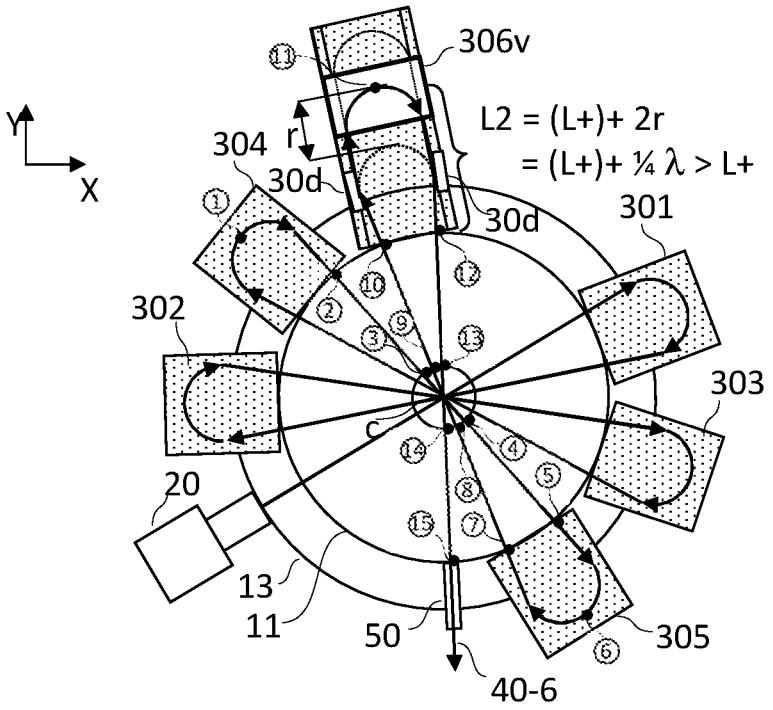
FIG.3I: 6 MeV
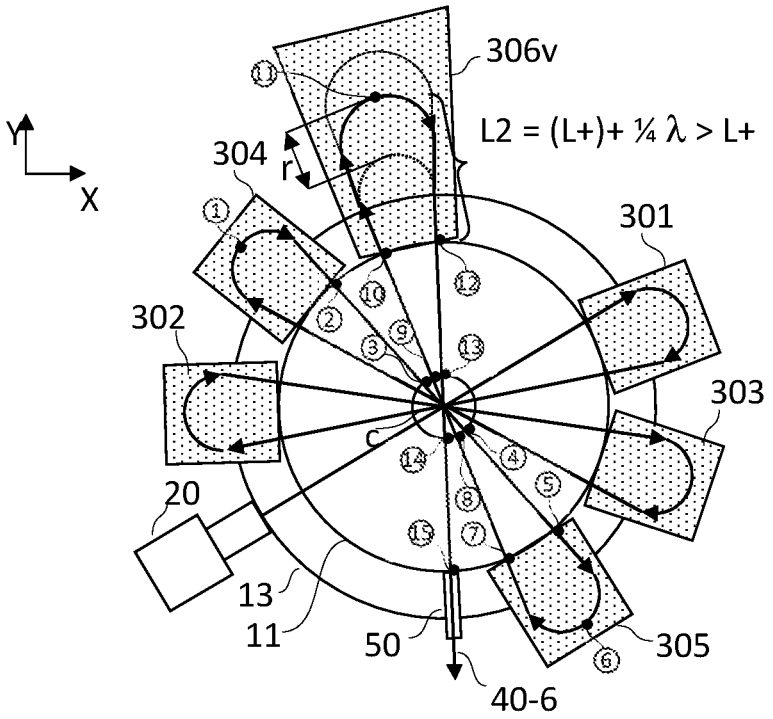
FIG.3J: 6 MeV

VARIO-ENERGY ELECTRON ACCELERATOR

FIELD OF THE INVENTION

The present invention relates to an electron accelerator having a resonant cavity centred on a central axis, Zc, and creating an oscillating electric field used for accelerating electrons along several radial trajectories forming the petals of a flower. A Rhodotron® is an example of such electron accelerator. An electron accelerator according to the present invention can extract an electron beam of different energies along a single path.

DESCRIPTION OF PRIOR ART

Electron accelerators having a resonant cavity are well known in the art. For example, EP0359774 describes an electron accelerator comprising:

(a) a resonant cavity consisting of a hollow closed conductor comprising:
  an outer wall comprising an outer cylindrical portion centred on a central axis, Zc, and having an inner surface forming an outer conductor section, and,
  an inner wall enclosed within the outer wall and comprising an inner cylindrical portion centred on the central axis, Zc, and having an outer surface forming an inner conductor section,
  the resonant cavity being symmetrical with respect to a mid-plane, Pm, normal to the central axis, Zc, and intersecting the outer cylindrical portion and inner cylindrical portion, (b) an electron source adapted for radially injecting an electron beam into the resonant cavity, from an introduction inlet opening on the outer conductor to the central axis, Zc, along the mid-plane, Pm, (c) an RF system coupled to the resonant cavity and adapted for generating an electric field, E, between the outer conductor and the inner conductor oscillating at a frequency ($f_{RF}$), to accelerate the electrons of the electron beam along radial trajectories in the mid-plane, Pm, extending from the outer conductor towards the inner conductor and from the inner conductor towards the outer conductor;

(d) a magnet system comprising several electromagnets adapted for deflecting the trajectories of the electron beam in a deflecting chamber from one radial trajectory to a different radial trajectory, each in the mid-plane, Pm, and passing through the central axis, Zc, from the electron source to an electron beam outlet.

In the following, the term "rhodotron" is used as synonym of an electron accelerator having a resonant cavity suitable for accelerating an electron beam over a planar trajectory normal to, and passing several times through the central axis, Zc.

As shown on FIGS. 1A&1B, the electrons of an electron beam are accelerated along the diameter (two radii, 2R) of the resonant cavity by the electric field, E, generated by the RF system between the outer conductor section and inner conductor section and between the inner conductor section and outer conductor section. The oscillating electric field, E, first accelerates electrons over the distance between the outer conductor section and inner conductor section. The polarity of the electric field changes when the electrons cross the area around the centre of the resonant cavity comprised within the inner cylindrical portion. This area around the centre of the resonant cavity provides a shielding from the electric field to the electrons which continue their trajectory at a constant velocity. Then, the electrons are accelerated again in the segment of their trajectory comprised between the inner conductor section and outer conductor section. The polarity of the electric field again changes when the electrons are deflected by an electromagnet. The process is then repeated as often as necessary for the electron beam to reach a target energy where it is discharged out of the rhodotron. The trajectory of the electrons in the mid-plane, Pm, thus has the shape of a flower (see FIG. 1). An accelerated electron beam can thus be extracted from the rhodotron with a given energy.

A rhodotron can be combined to external equipment such as a beam line and a beam scanning system. Rhodotrons can be used in industrial applications including sterilization (e.g., of medical devices), polymer modification, polymer crosslinking, pulp processing, modification of crystals, improvement of semi-conductors, beam aided chemical reactions, cold pasteurization and preservation of food, detection and security purposes, treatment of waste materials, etc. X-rays can also be produced by running an electron beam of appropriate energy into a metal target. X-rays can be used in different applications such as for example, (medical) radio-isotope production. The energies and intensity of the electron beams required are highly dependent on the application. Generally, electron beams of energy higher than 10 MeV are avoided to prevent induction and activation of nuclear reactions. X-rays are produced from electron beams of energy generally lower than 7.5 MeV. Electron beams of 7 MeV are usually well suited for sterilization of medical devices, surface sterilization, crosslinking of polymers, and the like. Food processing applications by electron beams can be broadly divided into,

- low-energy (<1 MeV), including the inline sterilization of packaging materials and the inline disinfestation/sterilization of seed surfaces;
- medium-energy (1-8 MeV), including phytosanitary treatment of packaged fruits and vegetables; and
- high-energy (8-10 MeV) applications. including pasteurization of packaged meats, spices, seafood, and food ingredients.

It can be appreciated from the foregoing that it would be advantageous if a given electron accelerator allowed the energy of the extracted electron beam to be varied depending on the desired application. This is the case with rhodotrons. Referring to FIGS. 1A and 1B, assuming an increase of energy, wi=1 MeV/pass after each crossing of the diameter of the resonant cavity by an electron beam, an electron beam of 7 MeV can be extracted after seven crossings of the resonant cavity as shown in FIGS. 1A and 2B & 2D. As illustrated in FIGS. 1B and 2C & 2E, by deactivating or removing two deflecting chambers (305, 306), the number of crossings of the resonant cavity can be reduced to five, resulting in an extracted electron beam of 5 MeV. A rhodotron unit can thus easily be configured to extract electron beams of different energies, by simply playing with the number of deflecting chambers, thus defining the number of 'petals' or passages of the beam across the resonant cavity.

The problem with changing energies of the extracted electron beam with current accelerators is that the extraction path changes direction with each energy, depending on the number and positions of deflecting chambers which are added or removed. As shown in FIGS. 1A and 1B, a target (100) intercepts a 7 MeV extracted electron beam along a first, rectilinear extraction trajectory, but if the same target (100) must be hit by a 5 MeV, the 5 MeV extracted electron beam must be deviated along a second, jagged trajectory to reach the target. Every deviation of the electron beam adds complexity and bulkiness of the system and increases production and installation costs.

EP3319403 proposes a rhodotron mounted on a rack such that its angular orientation can be varied, to maintain the same orientation of the extracted electron beam, whilst the number of deflecting chambers is varied. Although this design represents a great breakthrough compared with the previous accelerators, changing the orientation of the accelerator relative to the rack is, however, a substantial work and is not adapted for changing from a first application at 7 MeV in the morning to a second application at 5 MeV in the afternoon.

The present invention proposes a rhodotron capable of extracting electron beams of different energies along a single extraction path. The change of extraction energy is easy, quick and reliable and it can be discrete or continuous. This solution can be implemented to rhodotrons of any size, energy, and power and can also be implemented to existing rhodotron units by a simple modification. These advantages are described in more details in the following sections.

SUMMARY OF THE INVENTION

The present invention is defined in the appended independent claims. Preferred embodiments are defined in the dependent claims. In particular, the present invention concerns an electron accelerator comprising:

(a) a resonant cavity consisting of a hollow closed conductor comprising:
- an outer wall comprising an outer cylindrical portion having a central axis, Zc, and having an inner surface forming an outer conductor section, and,
- an inner wall enclosed within the outer wall and comprising an inner cylindrical portion of central axis, Zc, and having an outer surface forming an inner conductor section,
- wherein the resonant cavity is symmetrical with respect to a mid-plane, Pm, normal to the central axis, Zc, (b) an electron source adapted for radially injecting a beam of electrons (40) into the resonant cavity, from an introduction inlet opening on the outer conductor section to the central axis, Zc, along the mid-plane, Pm, (c) an RF system coupled to the resonant cavity and adapted for generating an electric field, E, between the outer conductor section and the inner conductor section, oscillating at a frequency ($f_{RF}$), to change the velocity of the electrons of the electron beam along radial trajectories in the mid-plane, Pm, extending from the outer conductor section towards the inner conductor section and from the inner conductor section towards the outer conductor section, (d) N magnet units, with N>1 and $N \in \mathbb{N}$, each one of the N magnet units being centred on the mid-plane, Pm, and comprising a set of deflecting magnets adapted for generating a magnetic field in a deflecting chamber in fluid communication with the resonant cavity by a cavity outlet aperture and a cavity inlet aperture, the magnetic field being adapted for,
- deflecting an electron beam entering into the deflecting chamber through the cavity outlet aperture at the end of a first radial trajectory in the resonant cavity along the mid-plane, Pm, over a first deflecting trajectory having an adding length (L+), said first deflecting trajectory extending from the cavity outlet aperture to the cavity inlet aperture, which can be the same as or different from the cavity outlet aperture, through which the electron beam is re-introduced into the resonant cavity towards the central axis along a second radial trajectory in the mid-plane, Pm, said second radial trajectory being different from the first radial trajectory, wherein
- the adding length (L+) is such that when the electron beam is re-introduced into the resonant cavity, the RF system is synchronized for applying an electric field for accelerating the electron beam along the second radial trajectory, (e) an outlet for extracting an accelerated electron beam of energy, W, from the resonant cavity towards a target, wherein at least one of the N magnet units is a vario-magnet unit adapted for modifying the corresponding first deflecting trajectory to a second deflecting trajectory of second length (L2) different from and preferably larger than the adding length (L+), thus allowing a variation of the energy, W, of the accelerated electron beam extracted from the outlet.

The second length (L2) is preferably such that when the electron beam is re-introduced into the resonant cavity, the RF system is synchronized for applying an electric field for decelerating the electron beam along the second radial trajectory.

In a first embodiment, the at least one vario-magnet unit is a discrete vario-magnet dual unit comprising,
- A first set of magnets centred on the mid-plane, Pm, located at a first radial distance from the central axis, Zc, and configured for deflecting the electron beam along a deflecting trajectory of adding length, L+, wherein the first set of magnets can be activated or deactivated to generate or not a magnetic field in the corresponding deflecting chamber, and
- a second set of magnets centred on the mid plane Pm, radially aligned with the first set of magnets and located at a second radial distance from the central axis, Zc, which is larger than the first radial distance.

The first and second set of magnets are preferably adapted for generating a magnetic field,
- in a single deflecting chamber common to both sets of magnets, or
- to a first and second deflecting chambers, respectively, the first deflecting chamber being in fluid communication with the second deflecting chamber by one or two windows.

In a second embodiment, the at least one vario-magnet unit is a moving vario-magnet unit comprising moving means for discretely or continuously moving radially the at least one vario-magnet units back and forth along a bisecting direction parallel to a bisector of the angle formed by the first and second radial trajectories at the central axis, Zc, and thus discretely or continuously varying the energy, W, of the accelerated electron beam extracted from the outlet. The moving means can comprise a motor for displacing back and forth the at least one moving vario-magnet unit along the corresponding bisecting direction.

In a preferred embodiment, the rhodotron can further comprise deflectors,
- for orienting the electron beam which reaches the cavity outlet aperture from the first radial trajectory to a trajectory parallel to a bisector of the angle formed by the first and second radial trajectories at the central axis, Zc, prior to being deflected circularly by the magnetic unit, and
- for orienting the electron beam which reaches the cavity inlet aperture from a trajectory parallel to the bisector following the circular deflection imposed by the magnetic unit, to the second radial trajectory upon being re-introduced into the resonant cavity.

The use of deflectors has the advantage that the gyroradius of the electron beam, and therefore the magnitude of the magnetic field, needs not be varied with the radial distance of neither first and second sets of magnets, nor of the moving vario-magnet.

The second length (L2) is preferably equal to the sum of the adding length (L+) and one or more halves of the wavelength, λ, of the electric field, E, i.e., $L2=(L+)+n\lambda/2$, with $n \in N$, and n is preferably equal to 1.

A preferred example of rhodotron comprises a single vario-magnet unit, which is positioned directly upstream of the outlet. The rhodotron is characterized by an energy gain or loss by an electron beam upon one pass across the resonant cavity to an $i^{th}$ magnet unit or from an $(i-1)^{th}$ magnet unit, defined as follows:

the value of wi is constant for i=1 to N, and the value of the energy gain or loss, wi, for the last $((N+1)^{th})$ pass of the electron beam across the resonant cavity to the outlet is comprised between (−wi) and (+wi), The number N of magnet units is preferably equal to 6, wi is preferably equal to 1 MeV/pass±0.2 MeV/pass for i=1 to 6 and comprised between −1 and 1 MeV/pass±0.2 MeV/pass for the last $(7^{th})$ pass, and wherein the extracted electron beam is preferably comprised between 5 MeV±0.2 MeV and 7 MeV±0.2 MeV.

Each of the N magnet units generates a magnetic field in the deflecting chamber preferably comprised between 0.01 T and 1.3 T, more preferably from 0.02 T to 0.7 T. The electron beam can have an average power comprised between 30 and 700 kW, preferably between 150 and 650 kW.

In a preferred embodiment, the resonant cavity is formed by:

a first half shell, having a cylindrical outer wall of inner radius, R, and of central axis, Zc, a second half shell, having a cylindrical outer wall of inner radius, R, and of central axis, Zc, and a central ring element of inner radius, R, sandwiched at the level of the mid-plane, Pm, between the first and second half shells, wherein the surface forming the outer conductor section is formed by an inner surface of the cylindrical outer wall of the first and second half shells, and by an inner edge of the central ring element, which is preferably flush with the inner surfaces of both first and second half shells.

DESCRIPTION OF THE DRAWINGS

These and further aspects of the invention will be explained in greater detail by way of example and with reference to the accompanying drawings.

FIG. 1 schematically shows two examples of top cross-sectional views along a plane normal to the central axis Zc of an electron accelerator of the prior art, arranged for delivering an extracted electron beam of 1(A) 7 MeV and 1(B) 5 MeV, by removing two deflecting chambers from the embodiment (A).

FIG. 2 shows (A) the RF electric field E amplitude as a function of the distance, d, of the trajectory followed by an electron beam in a rhodotron. The evolution of the energy, W, of the electron beam as a function of the position in a rhodotron of the prior art is shown in FIG. 2B for an extracted electron beam of (B) 7 MeV and in FIG. 2C for an extracted electron beam of 5 MeV. The circled numbers correspond to the positions of the electron beam in the rhodotron of corresponding FIGS. 2D & 2E, respectively, showing cross-sectional views of a rhodotron of the prior art configured for delivering an electron beam of (D) 7 MeV and (E) 5 MeV.

FIG. 3 shows (A) the RF electric field E amplitude as a function of the position, d, of an electron beam in a rhodotron. The evolution of the energy, W, of the electron beam as a function of the position in a rhodotron according to the present invention is shown for an extracted electron beam of (B) 7 MeV, (E) 5 MeV, and (D) 6 MeV. The circled numbers correspond to the positions of the electron beam in the rhodotrons of corresponding FIGS. 3E, 3G, 3F, 3H, and 3I, with FIGS. 3E&3G showing two embodiments of rhodotrons extracting an electron beam at 7 MeV, FIGS. 3F&3H showing the two embodiments of rhodotrons extracting electron beams at 5 MeV, and FIG. 3I showing the second embodiment at 6 MeV.

FIG. 4 schematically shows a cross sectional view along a plane parallel to the central axis Zc of an electron accelerator with a representation of the electrical field, E, profile along the central axis Zc.

Figure 5A:
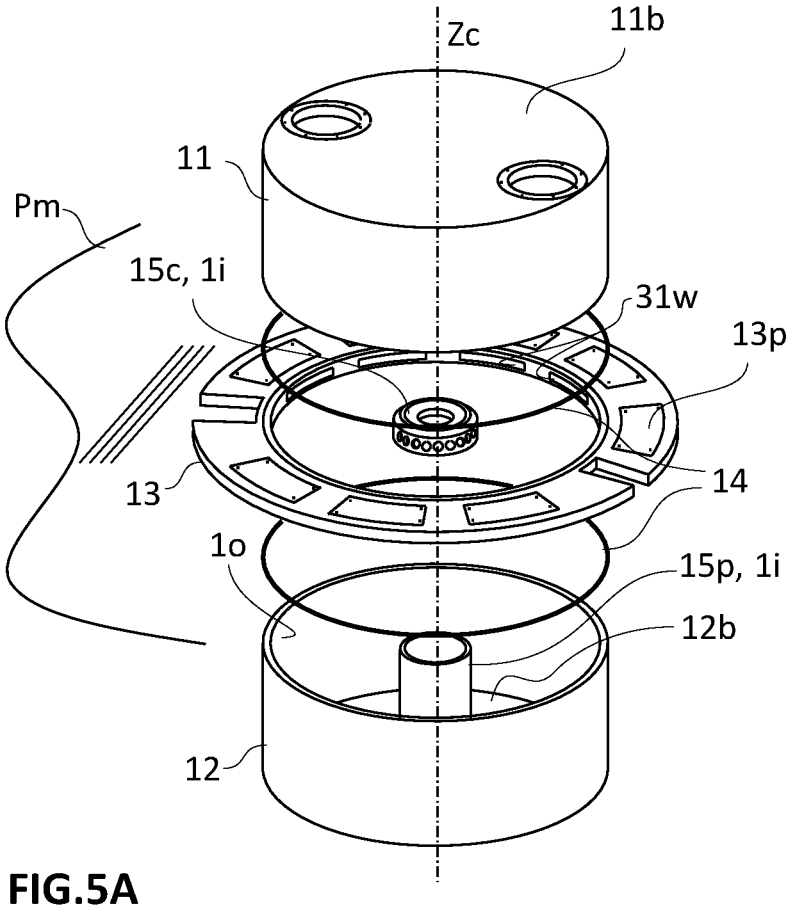
FIG. 5 shows (A) modules for producing a rhodotron, and (B) a deflecting chamber formed in the thickness of the central ring element.

The figures are not drawn to scale.

DETAILED DESCRIPTION

Rhodotron

FIGS. 1A, 1B, 2D & 2E, and 4 show an example of a rhodotron comprising:

a resonant cavity (1) consisting of a hollow closed conductor;

an electron source (20);

a vacuum system (not shown);

a RF system (70);

a magnet system comprising at least one magnet unit (30*i*).

Resonant Cavity

The resonant cavity (1) comprises:

a central axis, Zc;

an outer wall comprising an outer cylindrical portion coaxial to the central axis, Zc, and having an inner surface forming an outer conductor section (1*o*);

an inner wall enclosed within the outer wall and comprising an inner cylindrical portion coaxial to the central axis, Zc, and having an outer surface forming an inner conductor section (1*i*);

two bottom lids (11*b*, 12*b*) joining the outer wall and the inner wall, thus closing the resonant cavity;

a mid-plane, Pm, normal to the central axis, Zc, and intersecting the inner cylindrical portion and outer cylindrical portion. The intersection of the mid-plane and the central axis defines the centre of the resonant cavity.

The resonant cavity (1) is divided into two symmetrical parts with respect to the mid-plane, Pm. This symmetry of the resonant cavity with respect to the mid-plane concerns the geometry of the resonant cavity and ignores the presence of any openings, e.g., for connecting the RF system (70) or the vacuum system. The inner surface of the resonant cavity thus forms a hollow closed conductor in the shape of a toroidal volume. The height of the resonant cavity measured along the central axis, Zc is generally ½ λ, where λ is the RF wavelength. The diameter of the resonant cavity, measured normal to the central axis, Zc, can be 0.72λ to allow transit in the deflecting chambers.

The mid-plane, Pm, can be vertical, horizontal or have any suitable orientations with respect to the ground on which the rhodotron rests. Preferably, it is horizontal or vertical.

The resonant cavity (1) may comprise openings for connecting the RF system and the vacuum system (not shown). These openings are preferably made in at least one of the two bottom lids (11*b*, 12*b*).

The outer wall also comprises apertures intersected by the mid-plane, Pm. For example, the outer wall comprises an introduction inlet opening for introducing an electron beam (40) in the resonant cavity (1). It also comprises an electron beam outlet (50) for discharging out of the resonant cavity the electron beam (40-5 to 40-7) accelerated to a desired energy. It also comprises cavity outlet/inlet apertures (31*w*), bringing in fluid communication the resonant cavity with corresponding deflecting chamber (31, see below). Generally, a rhodotron comprises several magnet units and several cavity outlet/inlet apertures.

A rhodotron generally accelerates the electrons of an electron beam to energies which can be comprised between 1 and 50 MeV, preferably between 3 and 20 MeV, more preferably between 5 and 10 MeV. As discussed supra, to avoid nuclear reactions, energies of not more than 10 MeV are applied in most industrial applications. Electrons are relativistic and at 50 keV they reach 0.4 c (wherein c is the light speed), at 1 MeV, they reach about 0.94 c and at 10 MeV they reach 0.9988 c. After one passage across the resonant cavity, the velocity of the electrons at an energy of typically 1 MeV can safely be approximated as being substantially constant.

Rhodotrons have a high average power, which can be comprised between 30 to 700 kW, preferably between 150 and 650 kW, more preferably between 160 and 190 kW. For example, IBA's rhodotron model TT50 can extract a beam of energy of up to 10 MeV average power comprised between 1 and 10 kW. The TT50 has a resonant cavity of 0.6 m diameter and accelerates the electron beam by an energy gain, wi, per passage of 1 MeV/pass. With a resonant cavity of 1 m diameter, IBA's rhodotron model TT100 can extract electron beams of energy comprised between 3 and 10 MeV, with an energy gain, wi, per passage of 0.83 MeV/pass at a power of up to 40 kW. With a 2 m diameter resonant cavity, TT200 extracts 3 to 10 MeV electron beams at a rate wi=1 MeV/pass and at a power of up to 190 kW. The TT1000 has a resonant cavity of same diameter of 2 m as the TT200 but extracts beams of 3 to 7 MeV at a rate wi=1.2 MeV/pass at a power of up to 630 kW.

The inner wall comprises openings radially aligned with corresponding cavity outlet/inlet apertures (31*w*) permitting the passage of an electron beam through the inner cylindrical portion along a rectilinear radial trajectory (intersecting the central axis, Zc).

The surface of the resonant cavity (1) consisting of a hollow closed conductor is made of a conductive material. For example, the conductive material can be one of gold, silver, platinum, aluminium, preferably copper. The outer and inner walls and bottom lids can be made of steel coated with a layer of conductive material.

The resonant cavity (1) may have a diameter, 2R, comprised between 0.3 m and 4 m, preferably between 0.4 m and 3 m, more preferably between 0.5 m and 2 m.

The height of the resonant cavity (1), measured parallel to the central axis, Zc, can be comprised between 0.3 m and 4 m, preferably between 0.4 m and 1.2 m, more preferably between 0.5 m and 0.7 m.

The outer diameter of a rhodotron including a resonant cavity (1), an electron source (20), a vacuum system, a RF system, and one or more magnet units (30*i*), measured parallel to the mid-plane, Pm, may be comprised between 1 and 5 m, preferably between 1.2 and 2.8 m, more preferably between 1.4 and 1.8 m. The height of the rhodotron measured parallel to the central axis, Zc, may be comprised between 0.5 and 5 m, preferably between 0.6 and 1.5 m, more preferably between 0.7 and 1.4 m.

Electron Source, Vacuum System, and RF System

The electron source (20) is adapted for generating and for introducing an electron beam (40) into the resonant cavity along the mid-plane, Pm, towards the central axis, Zc, through an introduction inlet opening. For example, the electron source may be an electron gun. As well known by a person of ordinary skill in the art, an electron gun is an electrical component that produces a narrow, collimated electron beam that has a precise kinetic energy.

The vacuum system comprises a vacuum pump for pumping air out of the resonant cavity (1) and creating a vacuum therein.

The RF system is coupled to the resonant cavity (1) via a coupler and typically comprises an oscillator designed for oscillating at a resonant frequency, $f_{RF}$, for generating an RF signal of wavelength, λ, followed by an amplifier or a chain of amplifiers for achieving a desired output power at the end of the chain. The RF system thus generates a resonant radial electric field, E, in the resonant cavity. Absent any measure to the contrary, the resonant radial electric field, E, oscillates such as to accelerate the electrons of the electron beam (40) along a trajectory lying in the mid-plane, Pm, from the outer conductor section towards the inner conductor section, and, subsequently, from the inner conductor section towards a cavity outlet aperture (31*w*). The resonant radial electric field, E, is generally of the "TE001" type, which defines that the electric field is transverse ("TE"), has a symmetry of revolution (first "0"), is not cancelled out along one radius of the cavity (second "0"), and is a half-cycle of said field in a direction parallel to the central axis Z.

Magnet Units (30*i*)

N magnet units (30*i*) are distributed around an external circumference of the outer wall, and centred on the mid-plane Pm, with N>1 and N∈ℕ. Each one of the N magnet units comprises a set of deflecting magnets adapted for generating a magnetic field in a deflecting chamber (31). The deflecting chamber is in fluid communication with the resonant cavity (1) by a cavity outlet aperture and a cavity inlet aperture, which can be separate apertures or merge in a single aperture, all referred to by the numeral (31*w*). All the deflecting chamber enclose a portion of the mid-plane Pm.

Preferably, the magnet system comprises several magnet units (30*i* with i=1, 2, . . . N). N is equal to the total number of magnet units and is comprised between 1 and 15, preferably between 4 and 12, more preferably between 5 and 10. In conventional rhodotrons, the number N of magnet units yield (N+1) accelerations of the electrons of an electron beam (40) before it exits the rhodotron with a given energy (N+1)*wi, wherein wi is the energy gained or lost by an electron beam upon one pass across the resonant cavity to a magnet unit (30*i*) or from a magnet unit (30(*i*−1)). For example, FIGS. 1A and 2D illustrate rhodotrons with N=6 magnet units (301-306). FIGS. 1B and 2E show rhodotrons with N=4 magnet units (301-304). The energy gain, wi, at each passage across the resonant cavity illustrated in FIGS. 2B and 2C is of 1 MeV/pass, yielding extracted electron beams of energy (N+1)*1 MeV=7 MeV and 5 MeV, respectively.

The magnetic field generated in each deflecting chamber by the corresponding magnetic units is adapted for deflecting an electron beam entering into the deflecting chamber through the cavity outlet aperture at the end of a first radial trajectory in the resonant cavity along the mid-plane, Pm, over a first deflecting trajectory having an adding length (L+). The first deflecting trajectory extends from the cavity outlet aperture to the cavity inlet aperture, which can be the same as or different from the cavity outlet aperture, through which the electron beam is re-introduced into the resonant cavity towards the central axis along a second radial trajectory in the mid-plane, Pm. The second radial trajectory is different from the first radial trajectory and intersects the latter at the central axis, Zc. The adding length (L+) is such that when the electron beam is re-introduced into the resonant cavity, the RF system is synchronized for applying an electric field for accelerating the electron beam along the second radial trajectory between the cavity inlet aperture and the central axis, Zc (cf. FIGS. 2A, 2B, 2C, 3A and 3B-3D, section between positions (2) and (3)).

The electron beam is injected in the resonant cavity by the electron source (20) through the introduction inlet opening along the mid-plane, Pm. It follows a first radial trajectory in the mid-plane, Pm, said trajectory sequentially crossing:

- the outer wall through a cavity inlet aperture (31*w*);
- the inner wall through a cavity outlet aperture,
- the centre of the resonant opening (i.e. the central axis, Zc);
- the inner wall through a cavity inlet opening,
- the outer wall through a cavity outlet aperture (31*w*)
- a first deflecting chamber (31), and
- crossing back the outer wall through a cavity inlet aperture, which can be the same as or different from the last cavity outlet aperture.

As illustrated in FIG. 3B-3G, an electron beam exiting the resonant cavity through a cavity outlet aperture is deflected by the deflecting magnets of the magnet unit (30*i*) and reintroduced into the resonant cavity through a first cavity inlet aperture (31*w*) (which can be the same as or different from the first cavity outlet aperture) along a different radial trajectory, thus forming a first petal of a flower). The electron beam can follow such path a number N of times forming N petals centred on the central axis, Zc and comprised in the mid-plane Pm, until it reaches a target energy. The electron beam is then extracted out of the resonant cavity through an electron beam outlet (50).

The magnetic field required in the deflecting chambers must be sufficient for bending the trajectory of an electron beam exiting the resonant chamber along a radial trajectory through a cavity outlet aperture (31*w*) in an arc of circle of angle greater than 180° to drive it back into the resonant chamber along a second radial trajectory. For example, in a rhodotron comprising nine (9) magnet units (30*i*), the angle can be equal to 198°. The radius of the arc of circle (=gyroradius) can be of the order of 40 to 250 mm, preferably between 50 and 180 mm. The chamber surface must therefore have a length in a radial direction of the order of 65 to 260 mm. The magnetic field required for bending an electron beam to such arcs of circle is of the order of between 0.01 T and 1.3 T, preferably 0.02 T to 0.7 T, for example 0.2 or 0.3 T, depending on the desired gyroradius.

The magnet units may comprise electro-magnets which allow an easy control of the magnitude of the magnetic field created in the magnet unit. In a preferred embodiment, one or more magnet units, preferably N magnet units, may comprise a first and second permanent magnets instead of or additionally to a first and second electromagnets. Permanent magnets and electro-magnets are discussed below.

In the present document, a radial trajectory is defined as a rectilinear trajectory comprised in the mid-plane, Pm, and intersecting perpendicularly the central axis, Zc.

Vario-Magnet Unit

When a change of the target energy of an electron beam extracted from a rhodotron of the prior art is accompanied by a change of orientation of the extraction path of said electron beam requiring a re-orientation thereof towards a target (100) as illustrated in FIG. 1A for an energy of 7 MeV and in FIG. 1B for an energy of 5 MeV, the gist of the present invention is to provide at least one of the N magnet units (30*i*) as a "vario-magnet unit" (306-5, 306-7, 306*v*), which is a magnet unit adapted for modifying the corresponding first deflecting trajectory to a second deflecting trajectory of second length (L2) different from and preferably larger than the adding length (L+) (i.e., L2>L+), thus allowing a variation of the energy, W, of the accelerated electron beam extracted from the outlet (50). As can be seen by comparing the rhodotrons of FIG. 3E with FIG. 3F and FIG. 3G with both FIGS. 3H&3J, the use of a vario-magnet unit allows electron beams (40-5, 40-6, 40-7) of different energies to be extracted along a single extraction path through a single outlet (50).

Like in conventional rhodotrons, rhodotrons according to the present invention, provided with N magnet units (301-305), including at least one vario-magnet unit (306-5, 306-7, 306*v*), can generate (N+1) accelerations of the electrons of an electron beam (40) before it exits the rhodotron with a given energy (N+1)*wi. This is illustrated in FIG. 3B to 3G, wherein a rhodotron comprising N=6 magnet units, including a vario-unit (306-5, 306-7, 306*v*) extracts an electron beam of 7 MeV after (N+1)=7 successive passages across the resonant cavity. This result is obtained by setting the length of the deflecting trajectory in the vario-magnet unit (306-5, 306-7, 306*v*) to the same adding length, L+, of the deflecting trajectories of the other (non-vario-) magnet units (301-305). The rhodotron thus behaves like a traditional rhodotron of the prior art.

The vario-magnet units (306-5, 306-7, 306*v*) are suitable for varying the deflecting trajectory of the electron beam in the deflecting chamber from the first deflecting trajectory of length, L+, to a second deflecting trajectory of length, L2, different from, preferably higher than, the adding length, L+, of the first deflecting trajectory. This has the effect of changing the synchronization of the penetration into the resonant cavity of the electron beam through the cavity inlet cavity (31*w*) with respect to the frequency of the RF electric field E.

In a preferred embodiment, the second length (L2) is such that when the electron beam is re-introduced into the resonant cavity, the RF system is synchronized for applying an electric field for decelerating the electron beam along the second radial trajectory, thus reducing the energy W of the electron beam. For example, in the embodiment illustrated in FIGS. 3A, 3C&3F, the second length, L2, is longer than the adding length, L+, by ½λ (i.e., L2=((L+)+½ λ), so that a first electron penetrating into the resonant cavity through the cavity inlet aperture after a deflecting trajectory of adding length, L+, in a vario-magnet unit meets an electric field, E, of same magnitude as, but opposite sign to the electric field met by a second electron after a deflecting trajectory of second length, L2>L+. When the first electron is accelerated as it penetrates into the resonant cavity, the second electron, delayed by its longer deflecting trajectory, is decelerated by the electric field of opposite sign.

Referring to FIG. 3B it can be seen that, after being deflected by an adding length, L+, the first electron is accelerated (increase of energy, W) by a negative electric field between the outer wall (=position (12)) and the inner wall (=position (13)), and after crossing the central axis, Zc, is accelerated again by a positive electric field (between positions (14) and (15)), reaching an energy of 7 MeV at which it can be extracted through the outlet (50). By contrast and referring to FIG. 3C, the second electron after being deflected over a second length, L2, longer by ½ λ than the adding length, L+, is decelerated (drop of energy, W) by a positive electric field between the outer wall (=position (12)) and the inner wall (=position (13)), and after crossing the central axis, Zc, is decelerated again by a negative electric field (between positions (14) and (15)), reaching an energy of 5 MeV at which it can be extracted through the same outlet (50) as the first electron.

The terms "accelerated" and "decelerated" are used herein to refer to an change of energy, although the relativistic electron beam rapidly approaches the speed of light and its velocity can be approximated to be substantially constant, though not exactly constant. Irrespectively of the relativistic behaviour of the electrons, the energy of the electron beam increases at each passage through the resonant cavity by exposure to the electric field (W=q E d).

If the radial distance to the central axis, Zc, of a vario-magnet unit (306*v*, 306-5) is increased, the corresponding first and second radial trajectories are prolonged and since they are divergent, the radius of the deflecting trajectory (called "gyroradius") required to join the free ends of the first and second radial trajectories must also be increased. Since the gyroradius is inversely proportional to the magnetic field, absent any other measure for preventing such increase of the gyroradius, the magnetic field of a vario-magnetic unit must decrease with increasing radial distance to the central axis, Zc. The increase of the gyroradius with increasing radial distance to the central axis, Zc, of a vario-magnet unit is clearly visible in FIGS. 3F and 3J.

In a preferred embodiment illustrated in FIGS. 3G, 3H, and 3I, the gyroradius of a vario-energy unit can be maintained constant independent of the radial distance thereof to the central axis, Zc, by using deflectors (30*d*) for deflecting the trajectories of the electron beam as follows:

- orienting the electron beam which reaches the cavity outlet aperture from the first radial trajectory to a trajectory parallel to a bisector of the angle formed by the first and second radial trajectories at the central axis, Zc, prior to being deflected circularly by the magnetic unit, and
- orienting the electron beam which reaches the cavity inlet aperture from a trajectory parallel to the bisector following the circular deflection imposed by the magnetic unit, to the second radial trajectory upon being re-introduced into the resonant cavity.

In a preferred embodiment, the rhodotron comprises a single vario-magnet unit (306-5, 306-7, 306*v*)), which is positioned directly upstream of the outlet (50). The energy wi gained or lost by an electron beam upon one pass across the resonant cavity to a magnet unit (30*i*) or from a magnet unit (30(*i*−1)), is constant for i=1 to N, and varies between (−wi) and (+wi) for the last ((N+1)$^{th}$) pass of the electron beam across the resonant cavity to the outlet (50). With N=6, and wi=1 MeV/pass for i=1 to 6 and comprised between −1 and 1 MeV/pass for the last (7$^{th}$) pass, as in the embodiment of FIG. 3, the extracted electron beam (40-5 to 40-7) has an energy comprised between 5 and 7 MeV.

The use of at least one vario-magnet unit (306*v*, 306-5, 306-7) in a rhodotron elegantly solves the problem of extracting along a single path electron beams (40-5 to 40-7) of different energies, W. Different types of vario-magnet units can be implemented in the present invention, including discrete vario-magnet dual units (306-5, 306-7) and moving vario-magnet units (306*v*).

Discrete Vario-Magnet Dual Unit

In a first embodiment illustrated in FIGS. 3E and 3F the vario-magnet unit (306-5, 306,7) comprises two sets of magnets.

- A first set of magnets (306-7) centred on the mid-plane, Pm, located at a first radial distance from the central axis, Zc, and configured for deflecting an electron beam over an adding length, L+, wherein the first set of magnets can be activated or deactivated to generate or not a magnetic field; When activated, the first set of magnet synchronizes the penetration of the electron beam into the resonant cavity synchronized with an accelerating electric field E.
- A second set of magnets (306-5) centred on the mid plane Pm, radially aligned with the first set of magnets and located at a second radial distance from the central axis, Zc, which is larger than the first radial distance. The second set of magnets (306-5) when the first set of magnets (306-7) is deactivated, is configured for deflecting an electron beam over a second distance, L2>L+. When the first set of magnets is deactivated, the second set of magnets synchronizes the penetration of the electron beam into the resonant cavity with an electric field E, which is not as accelerating as with the first set of magnets. Preferably, the penetration of the electron beam into the resonant cavity synchronized with a decelerating electric field E.

The first and second set of magnets (306.7, 306-5) can be adapted for generating a magnetic field either in a single deflecting chamber (31) common to both sets of magnets, or to a first and second deflecting chambers (31), respectively, the first deflecting chamber being in fluid communication with the second deflecting chamber by one or two windows. The two-chamber option of the present invention can be implemented very easily on existing conventional rhodotrons.

The foregoing vario-magnet unit configuration permits toggling between two predefined and discrete values of energies, W. For this reason, this embodiment can be referred to as "discrete vario-magnet dual unit." Toggling from the first set (306-7) to the second set of magnets (306-5) can be done very easily by activating and deactivating the first set of magnets (306-7). Deactivating the first set of magnets can be easily performed with electro-magnets by feeding or not electrical current. If permanent magnets are used instead, they must be removed far enough from the deflecting chamber to drop the magnetic field at the level of the mid-plane Pm. Preferably, the first set of magnets comprises electro-magnets.

In FIG. 3, each pass after a deflection in one of the five non-vario magnet units (301-305) yield an energy gain per pass, wi=1 MeV/pass, corresponding to a TT200 rhodotron model produced by IBA. An electron beam therefore penetrates into the vario-magnet unit with a cumulated energy of (N+1) wi=6 MeV. The sixth vario-magnet unit (306-5, 306-7, 306*v*) is the last before the outlet (50). The vario-magnet unit in Example 3 can therefore vary the energy of the extracted electron beam to values centred on 6 MeV±1 MeV.

Of course, the number N of magnets is not necessarily six, the number of non-vario magnet units (301-305) can be different from five, and the number of vario-magnet units can be more than one and is not necessarily located at the last position before the outlet (50). Care should be taken if a vario magnet unit is not at the last position, that the change in synchronization with the RF electric field provoked by a vario-magnet unit is maintained to the following passes including non-vario magnet units. A skilled person can easily design the best arrangement of vario- and non-vario-magnet units to yield the desired energy ranges of extracted electron beams.

A discrete vario-magnet dual unit affords toggling between two predefined second lengths, L2, only. A third magnet unit could be envisaged, but the size of the rhodotron comprising such discrete vario-magnet triple- (or more) units would increase accordingly. If more than two energies (second lengths, L2) are desired, other designs are available, such as a moving vario-magnet unit.

Moving Vario-Magnet Unit

In a second embodiment illustrated in FIGS. 3F, 3H, and 3I, the at least one vario-magnet units (306*v*) comprises moving means for discretely or continuously moving radially the at least one vario-unit back and forth along a bisecting direction parallel to a bisector of the angle formed by the first and second radial trajectories at the central axis, Zc. This way, the second length, L2, of the deflecting trajectory can be varied according to the radial position of the vario-magnet unit and the desired synchronization with the RF electric field can be set to obtain a desired electron beam energy, W. When the discrete vario-magnet dual unit discussed before only affords toggling between two predefined electron beam energies corresponding to two predefined second lengths, L2, the present embodiment of a moving vario-magnet unit allows the second length, L2, to be varied over more than two predefined values. The moving vario-magnet unit can move discretely or continuously along the bisecting direction between two boundary positions. For example, the two boundary positions can include:

- a closest position corresponding to a deflecting trajectory of adding length, L+, synchronized with the RF electric field to yield a continuous acceleration of the electron beam across the resonant cavity, and
- a furthest position located further away from the central axis, Zc, than the closest position and corresponding to a deflecting trajectory of second length, L2=(L+)+½ λ, synchronized with the RF electric field to yield a continuous deceleration of the electron beam across the resonant cavity. Preferably the furthest position defines a second length L2 equal to the sum of the adding length (L+) and one or more halves of the wavelength, λ, of the electric field, E (L2=(L+)+(n/2) λ).

The moving vario-magnet unit (306*v*) can move between the closest and furthest positions either continuously or at discrete positions, to vary the second length, L2, between L+ and (L+)+½ λ, so as to obtain an energy gain at the next crossing of the resonant cavity comprised between wi and −wi. In the example of FIG. 3, wi=1 MeV/pass so that the energy gained (or lost) by the electron beam upon the next pass through the resonant cavity can be varied between −1 MeV and +1 MeV. After six passes before penetrating into the last vario-magnet unit, an electron beam has cumulated an energy of (N+1) wi=6 MeV. The energy of the extracted electron beam can therefore vary in the following manner

- The energy gain wi across the resonant cavity following a deflecting trajectory of length L+ through the vario-magnet unit (306*v*) at its closest position is therefore +1 MeV, yielding an extracted electron beam (40-7) of 7 MeV in the example of FIGS. 3B and 3G.
- The energy gain (loss) wi across the resonant cavity following a deflecting trajectory of length (L+)+½ λ, through the vario-magnet unit (306*v*) at its furthest position is therefore −1 MeV, yielding an extracted electron beam (40-5) of 5 MeV in the example of FIGS. 3C and 3H.
- If the vario-magnet unit (306*v*) is at an intermediate position between the closest and the furthest positions, as illustrated in FIG. 3I, the energy gain wi during the next pass through the resonant cavity is comprised between −1 MeV and +1 MeV. Referring to FIG. 3D, it can be seen that if the second length, L2=(L+)+¼ λ, the energy gain wi=0 MeV at the next pass, yielding an extracted electron beam (40-6) of 6 MeV.

The energy of the extracted electron beam can thus be set to any value comprised between 5 and 7 MeV in the example illustrated in FIG. 3.

A continuous moving is advantageous for a higher flexibility on the control of the energy of the extracted electron beam. On the other hand, a number of predefined discrete positions is easier to use for an operator, with second lengths, L2, strategically predefined as L2=(L+)+(n/m) λ, wherein n/m defines simple fractions with n and m∈N and n≤m≤6.

As illustrated in FIG. 3J, a moving vario-magnet unit (306*v*) can be configured such that the magnitude of the magnetic field automatically decreases as a function of the radial distance thereof to the central axis (Zc) to accommodate the value of the gyroradius to the distance separating the first and second radial trajectories. This can easily be achieved by controlling the current fed to electro-magnets.

Alternatively, deflectors (30*d*) as discussed supra can be used instead. The deflectors (30*d*) orient the trajectories of an electron beam between the cavity outlet/inlet apertures and the vario-magnet unit into straight segments parallel to the bisector of the angle formed by the first and second radial trajectories at the central axis, Zc. This embodiment is advantageous as it permits to keep constant the magnetic field generated by the vario-magnet unit regardless of the position of the vario-magnet unit (306*v*). The second length, L2, of the second deflecting trajectory is therefore simply equal to L2=(L+)+2 r, wherein r is the distance increase of the vario-magnet unit to the central axis, Zc (cf. FIGS. 3H and 3I). The use of deflectors (30*d*) allows the vario-magnet unit to comprise permanent magnets, instead of or additionally to electro-magnets.

The moving means of the moving vario-magnet unit (306*v*) may comprise a motor for displacing back and forth the the moving vario-magnet unit (306*v*) along the corresponding bisecting direction.

A rhodotron comprising N magnet units, of which (N−1) are non-vario magnet units (301-305) and one only is a vario-magnet unit (306-5, 306-7, 306*v*) positioned directly upstream of the outlet (50) can extract an electron beam of energy ranging between wi (N±1). Each time an electron beam crosses the resonant cavity of a rhodotron illustrated in FIG. 3, it gains an energy, wi=1 MeV/pass. Since the rhodotrons of FIG. 3 comprise (N−1)=5 non-vario-magnet units (301-305), they can extract electron beams of energies comprised between 5 MeV and 7 Mev (cf. #40-5 in FIGS. 3F&3H, #40-6 in FIGS. 3I&3J, and #40-7 in FIGS. 3E&3G).

Permanent Magnets and Electro-Magnets

The magnet units in conventional rhodotrons are generally provided with electro-magnets. It has been discussed in EP3319402 that magnet units provided with permanent magnets could be used instead. A rhodotron according to the present invention may comprise electro-magnets only, permanent magnets only, or a combination of electro-magnets and permanent magnets.

As discussed in EP3319402, permanent magnets have the advantage over electro-magnets of decreasing the energy consumption of the rhodotron since, contrary to electro-magnets, permanent magnets need not be powered. Permanent magnets can be coupled directly against the outer wall of the resonant cavity, whilst the coils of electro-magnets must be positioned at a distance of the outer wall. By allowing the magnet units to be directly adjacent to the outer wall, the construction of the rhodotron is greatly simplified and the production cost reduced accordingly.

One major drawback of permanent magnets is that the magnetic field cannot be varied as easily as with electro-magnets. As illustrated in FIG. 4, EP3319402 proposes to solve this problem, by forming each of the first and second permanent magnets of a magnet unit by arranging a number of discrete magnet elements (32), side by side in an array parallel to the mid-plane, Pm. The array is formed by one or more rows of discrete magnet elements. An array is disposed on either side of the deflecting chamber with respect to the mid-plane, Pm. By varying the number of discrete magnet elements in each array, the magnetic field created in the deflecting chamber can be varied accordingly.

By contrast, the magnitude of the magnetic field generated by electro-magnets is very easy to control by controlling the electric current fed to the coils of the electro-magnets. They are, however, bulky and need wiring which complexifies the production of the rhodotron. A combination of electro-magnets and permanent magnets can therefore be used to profit of the advantages and avoid the drawbacks of each type of magnets. In a preferred embodiment, all magnet units comprise permanent magnets, but the ones requiring frequent tuning of the magnetic field. These include, for example,

- the first magnet unit (301) located opposite the electron source (20) can differ from the other (N−1) magnet units, because the electron beam reaches said first magnet unit at a lower speed than the other magnet units. In order to return the electron beam into the resonant cavity in phase with the oscillating electric field, the deflecting path in the first magnet unit must be slightly different from the (N−1) remaining magnet units. The first magnet unit (301) can therefore be an electro-magnet, allowing an easy fine tuning of the magnetic field generated in the corresponding deflecting chamber (31).
- The first set of magnets (306-7) of a discrete vario-magnet dual unit, which must be switched off to allow an electron beam to reach the second set of magnets (306-5) (cf. FIGS. 3E&3F). On the other hand, the second set of magnets can comprise permanent magnets.
- A moving vario-magnet unit (306*v*) devoid of any deflector (30*d*), as the magnetic field must vary according to position of the vario-magnet unit, to yield a corresponding gyroradius for the desired deflecting trajectory (cf. FIG. 3J).

As described in EP3319403 the rhodotron can have a modular construct as illustrated in the exploded view of FIG. 5A. Each of the first and second half shells forming the resonant cavity comprises a cylindrical outer wall, a bottom lid (11*b*, 12*b*), and a central pillar (15*p*) jutting out of the bottom lid. A central chamber (15*c*) can be sandwiched between the central pillars of the first and second half shells.

As visible in FIG. 5A, a central ring element (13) is sandwiched between the first and second half-shells. The central ring element has a first and second main surfaces separated from one another by a thickness thereof. A portion of the central ring element extends radially beyond an outer surface of the outer wall of both first and second half shells, forming a flange extending radially outwards. The magnet units (30*i*) can be mounted on and fitted onto said flange. The fit between the magnet units and the flange preferably affords some play for finely aligning the magnet units with the mid-plane, Pm, and the trajectory of the electron beam.

Figure 5B:
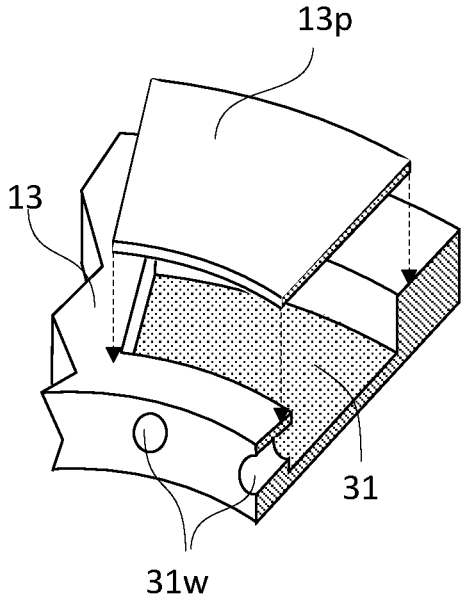

In a preferred embodiment illustrated in FIG. 5B, the deflecting chambers (31) of the magnet units can be formed by a hollowed cavity in the thickness of the central ring element, with the cavity outlet/inlet apertures (31*w*) being formed at the inner edge of the central ring element, facing the centre of the central ring element and the central axis, Zc. The hollowed cavity can be closed by a lid (13*p*). Preferably, several deflecting chambers, more preferably all the deflecting chambers of the rhodotron are formed by individual hollowed cavities in the thickness of the central ring element, with the corresponding cavity outlet/inlet apertures being formed in the inner edge of the central ring element, facing the central axis, Zc. This construction reduces substantially the production costs of rhodotrons compared to conventional designs for the following reasons.

Advantages

With the present invention, it is now possible to extract electron beams of different energies along a single extraction path. This solution is very advantageous to the industry in that a single rhodotron can be used for different applications, such sterilizing medical devices, or treating different foodstuff, by a single tuning of the one or more vario-magnet units.

| REF # | Feature |
|---|---|
| 1 i | inner conductor |
| 1 o | outer conductor |
| 1 | resonant cavity |
| 11 | first half shell |
| 11 b | bottom lid of first half shell |
| 12 | second half shell |
| 12 b | bottom lid of second half shell |
| 13 | central ring |
| 13 p | cover plate |
| 14 | sealing O-ring |
| 20 | electron source |
| 30 1. . . | individual magnet unit |
| 30 i | magnet unit (in general) |
| 30 6-5 | Discrete vario-magnet dual unit for decelerating the electron beam |
| 30 6-7 | Discrete vario-magnet dual unit for accelerating the electron beam |
| 306 v | Moving vario-magnet unit |
| 31 w | deflecting window |
| 31 | deflecting chamber |
| 32 i | discrete magnet element |
| 32 | permanent magnet |
| 33 c | chamber surface |
| 33 m | magnet surface |
| 33 | support element |
| 35 | yoke of magnet unit |
| 40 | electron beam |
| 40 -5 | 5 MeV electron beam |
| 40 -7 | 7 MeV electron beam |
| 50 | electron beam outlet |
| 50 -5 | 5 MeV electron beam outlet (prior art) |
| 50 -7 | 7 MeV electron beam outlet (prior art) |
| 60 | tool for adding or removing magnet elements |

-continued

| REF # | Feature |
|---|---|
| 61 | elongated profile of tool |
| 62 | elongated pusher of tool |
| 70 | RF system |
| 100 | Target |

The invention claimed is:

1. An electron accelerator comprising:

a resonant cavity consisting of a hollow closed conductor comprising:

an outer wall comprising an outer cylindrical portion having a central axis, Zc, and having an inner surface forming an outer conductor section, and, an inner wall enclosed within the outer wall and comprising an inner cylindrical portion of central axis, Zc, and having an outer surface forming an inner conductor section, wherein the resonant cavity is symmetrical with respect to a mid-plane, Pm, normal to the central axis, Zc, an electron source configured for radially injecting a beam of electrons into the resonant cavity, from an introduction inlet opening on the outer conductor section to the central axis, Zc, along the mid-plane, Pm, an RF system coupled to the resonant cavity and configured for generating an electric field, E, between the outer conductor section and the inner conductor section, oscillating at a frequency, $f_{RF}$, to change the velocity of the electrons of the electron beam along radial trajectories in the mid-plane, Pm, extending from the outer conductor section towards the inner conductor section and from the inner conductor section towards the outer conductor section, N magnet units, with N>1 and $N \in \mathbb{N}$, each one of the N magnet units being centered on the mid-plane, Pm, and comprising a set of deflecting magnets configured for generating a magnetic field in a deflecting chamber in fluid communication with the resonant cavity by a cavity outlet aperture and a cavity inlet aperture, the magnetic field being configured for:

deflecting an electron beam entering into the deflecting chamber through the cavity outlet aperture at the end of a first radial trajectory in the resonant cavity along the mid-plane, Pm, over a first deflecting trajectory having an adding length, said first deflecting trajectory extending from the cavity outlet aperture to the cavity inlet aperture, through which the electron beam is re-introduced into the resonant cavity towards the central axis along a second radial trajectory in the mid-plane, Pm, the second radial trajectory being different from the first radial trajectory, wherein the adding length is such that when the electron beam is re-introduced into the resonant cavity, the RF system is synchronized for applying an electric field for accelerating the electron beam along the second radial trajectory, and an outlet for extracting an accelerated electron beam of energy, W, from the resonant cavity towards a target, wherein at least one of the N magnet units is a vario-magnet unit configured for modifying the corresponding first deflecting trajectory to a second deflecting trajectory of second length different from the adding length thus allowing a variation of an energy, W, of the accelerated electron beam extracted from the outlet.

2. The electron accelerator according to claim 1, wherein the second length is such that when the electron beam is re-introduced into the resonant cavity, the RF system is synchronized for applying an electric field for decelerating the electron beam along the second radial trajectory.

3. The electron accelerator according to claim 1, wherein the at least one vario-magnet unit comprises, a first set of magnets centered on the mid-plane, Pm, located at a first radial distance from the central axis, Zc, and configured for deflecting the electron beam along a deflecting trajectory of adding length, L+, wherein the first set of magnets can be activated or deactivated to generate or not a magnetic field in the corresponding deflecting chamber, and a second set of magnets centered on the mid plane, Pm, radially aligned with the first set of magnets and located at a second radial distance from the central axis, Zc, which is larger than the first radial distance.

4. The electron accelerator according to claim 3, wherein the first and second set of magnets are configured for generating a magnetic field, in a single deflecting chamber common to both sets of magnets.

5. The electron accelerator according to claim 1, wherein the at least one vario-magnet unit comprises moving means for discretely or continuously moving radially the at least one vario-magnet units back and forth along a bisecting direction parallel to a bisector of the angle formed by the first and second radial trajectories at the central axis, Zc, and thus discretely or continuously varying the energy, W, of the accelerated electron beam extracted from the outlet.

6. The electron accelerator according to claim 5, wherein the moving means comprise a motor for displacing back and forth the at least one vario-magnet units along the corresponding bisecting direction.

7. The electron accelerator according to claim 3, further comprising deflectors configured for:

orienting the electron beam which reaches the cavity outlet aperture from the first radial trajectory to a trajectory parallel to a bisector of the angle formed by the first and second radial trajectories at the central axis, Zc, prior to being deflected circularly by the magnetic unit, and orienting the electron beam which reaches the cavity inlet aperture from a trajectory parallel to the bisector following the circular deflection imposed by the magnetic unit, to the second radial trajectory upon being re-introduced into the resonant cavity.

8. The electron accelerator according to claim 2, wherein the second length is equal to the sum of the adding length, L+, and one or more halves of a wavelength, λ, of the electric field, E.

9. The electron accelerator according to claim 1, further comprising;

a single vario-magnet unit, which is positioned directly upstream of the outlet, wherein wi is the energy gained or lost by an electron beam upon one pass across the resonant cavity to a magnet unit or from a magnet unit, with the value of wi being constant for i=1 to N, and with the value of the energy gain, wi, for the last pass of the electron beam across the resonant cavity to the outlet being comprised between (−wi) and (+wi), and wherein N is equal to 6, wi is equal to 1 MeV/pass for i=1 to 6 and comprised between −1 and 1 MeV/pass for a last pass, and wherein the extracted electron beam is comprised between 5 and 7 MeV.

10. The electron accelerator according to claim 1, wherein each of the N magnet units forms a magnetic field in the deflecting chamber comprised between 0.01 T and 1.3 T.

11. The electron accelerator according to claim 1, wherein the electron beam has an average power comprised between 30 and 700 kW.

12. The electron accelerator according to claim 1, wherein the resonant cavity is formed by:

a first half shell, having a cylindrical outer wall of inner radius, R, and of central axis, Zc, a second half shell, having a cylindrical outer wall of inner radius, R, and of central axis, Zc, and a central ring element of inner radius, R, sandwiched at the level of the mid-plane, Pm, between the first and second half shells, wherein a surface forming an outer conductor section is formed by an inner surface of the cylindrical outer wall of the first and second half shells, and by an inner edge of the central ring element, which is flush with the inner surfaces of both first and second half shells.

13. The electron accelerator according to claim 3, wherein the first and second set of magnets are configured for generating a magnetic field to a first and second deflecting chambers respectively, the first deflecting chamber being in fluid communication with the second deflecting chamber by one or more windows.

* * * * *